US005113165A

United States Patent [19]

Ackermann

[11] Patent Number: 5,113,165

[45] Date of Patent: May 12, 1992

[54] SUPERCONDUCTIVE MAGNET WITH THERMAL DIODE

[75] Inventor: Robert A. Ackermann, Schenectady, N.Y.

[73] Assignee: General Electric Company, Schenectady, N.Y.

[21] Appl. No.: 562,351

[22] Filed: Aug. 3, 1990

[51] Int. Cl.[5] ..... H01F 7/22

[52] U.S. Cl. ..... 335/216; 335/300; 335/301; 335/299; 505/879; 62/45.1

[58] Field of Search ..... 174/15.4; 335/216, 300, 335/296, 299, 301; 62/45.1, 51.1; 505/1, 879, 875, 891, 892, 894, 898, 899, 907

[56] References Cited

U.S. PATENT DOCUMENTS 4,743,880 5/1988 Breneman ..... 335/301
4,924,198 5/1990 Laskaris ..... 335/216
4,926,646 5/1990 Dorri ..... 62/51.1
4,926,657 5/1990 Bomar ..... 62/311
4,935,714 6/1990 Vermilyea ..... 335/216

*Primary Examiner*—Leo P. Picard
*Assistant Examiner*—Trinidad Korka
*Attorney, Agent, or Firm*—James R. McDaniel; James C. Davis, Jr.; Paul R. Webb, II

[57] ABSTRACT

A superconductive magnet having at least one superconductive coil is provided. A thermal radiation shield is situated inside a vacuum vessel and the thermal radiation shield encloses the superconductive coil. A thermal diode is provided for thermally linking the superconductive coil and the thermal radiation shield when the thermal radiation shield is colder than the superconductive coil.

16 Claims, 2 Drawing Sheets

SUPERCONDUCTIVE MAGNET WITH THERMAL DIODE

BACKGROUND OF THE INVENTION

The present invention relates to refrigerated superconductive magnets with thermal diode coil supports.

Conduction cooled superconductive magnets which rely on two stage cryocoolers rather than consumable cryogens for cooling of the type shown and claimed in U.S. Pat. No. 4,924,198 can take several days to cool down from ambient temperatures using just the cryocooler which is sized for steady state operation. The amount of sensible heat to be extracted from the magnet is large due to the large mass of the magnet particularly those which are used for whole body magnetic resonance imaging.

The cryocooler has a first stage which provides cooling at 40K to a thermal radiation shield and a second stage which provides cooling at 10K to the superconductive coils. The cooling capacity at the second stage is small, on the order of 2 to 5 watts, which is adequate for steady stage operation.

One previous approach to solve this problem is disclosed in U.S. Pat. No. 4,926,646 in which the two stage cryocooler is replaced during part of the cool down period by a precooler through which a cryogen is pumped such as liquid nitrogen which boils and cools the portion of the magnet normally cooled by the first and second stages of the cryocooler. The cryocooler is replaced and the cooling continues until operating temperatures are ready.

Another approach is shown in U.S. Pat. No. 4,926,657 in which cooling passageways are made in integral parts of the two stage cryocooler interface and are initially cooled by introducing a cryogen such as nitrogen which boils off cooling the magnet. The cryocooler is then operated to cool the magnet to operating temperatures.

Both of these approaches have the disadvantage of requiring liquid cryogen including the inherent problems of handling and storage. The refrigerated magnet does not require consumable cryogen for persistent operation.

It is an object of the present invention to provide a refrigerated magnet which can be more quickly cooled without requiring a larger cryocooler or the use of consumable cryogens.

It is another object of the present invention to provide a refrigerated magnet which can be more quickly cooled without removing the cryocooler.

It is still another object of the present invention to provide a refrigerated magnet which can be more quickly cooled which does not require the use of any moving parts.

SUMMARY OF THE INVENTION

In one aspect of the present invention a superconductive magnet having at least one superconductive coil is provided. A thermal radiation shield is situated inside a vacuum vessel and the thermal radiation shield encloses the superconductive coil. Thermal diode means is provided for thermally linking the superconductive coil and the thermal radiation shield when the thermal radiation shield is colder than the superconductive coil.

In one aspect of the present invention a superconductive magnet for use in magnetic resonance spectroscopy is provided having at least one superconductive coil. A thermal radiation shield is situated inside the vacuum vessel. The thermal radiation shield encloses the superconductive coil. A pressure tight tube having heat transfer means enclosing either end of the tube is provided. The tube contains a gas. The heat transfer means on one end of the tube is thermally connected with the thermal radiation shield and the heat transfer means on the other end of the tube is thermally connected with the superconductive winding. The central axis of the tube is situated substantially vertically, with the heat transfer means at the end of the tube thermally connected with the thermal radiation shield located at the higher end, so that the gas in the tube thermally links the two ends of the tube when the thermal radiation shield is colder than the superconductive winding.

BRIEF DESCRIPTION OF THE DRAWING

The subject matter which is regarded as the invention, is particularly pointed out and distinctly claimed in the concluding portion of the specification. The invention, however, both as to organization and method of practice, together with further objects and advantages thereof, may best be understood by reference to the following description taken in conjunction with the accompanying drawing figures in which:

DETAILED DESCRIPTION OF THE INVENTION

Figure 1:
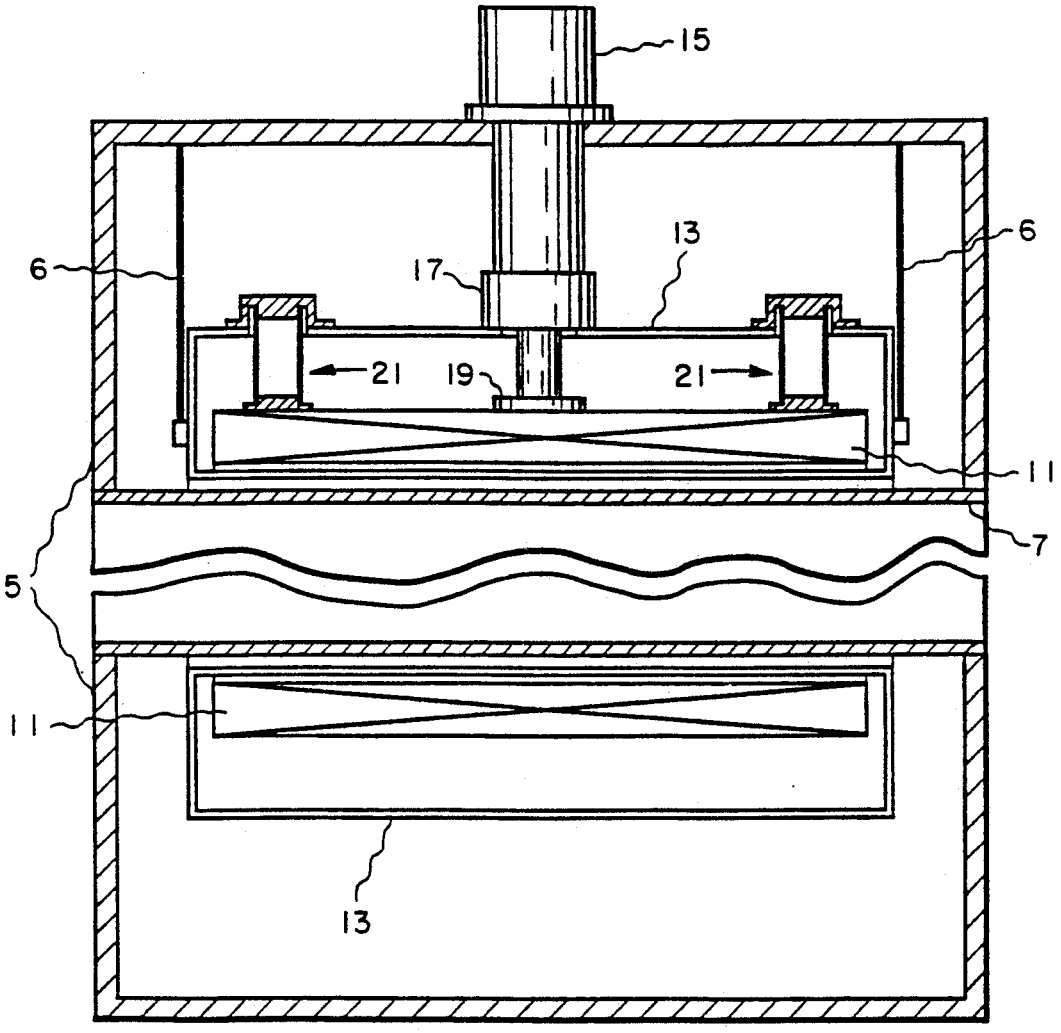
FIG. 1 is a partial sectional view of a superconductive magnet with thermal diodes in accordance with the present invention.
Figure 2:
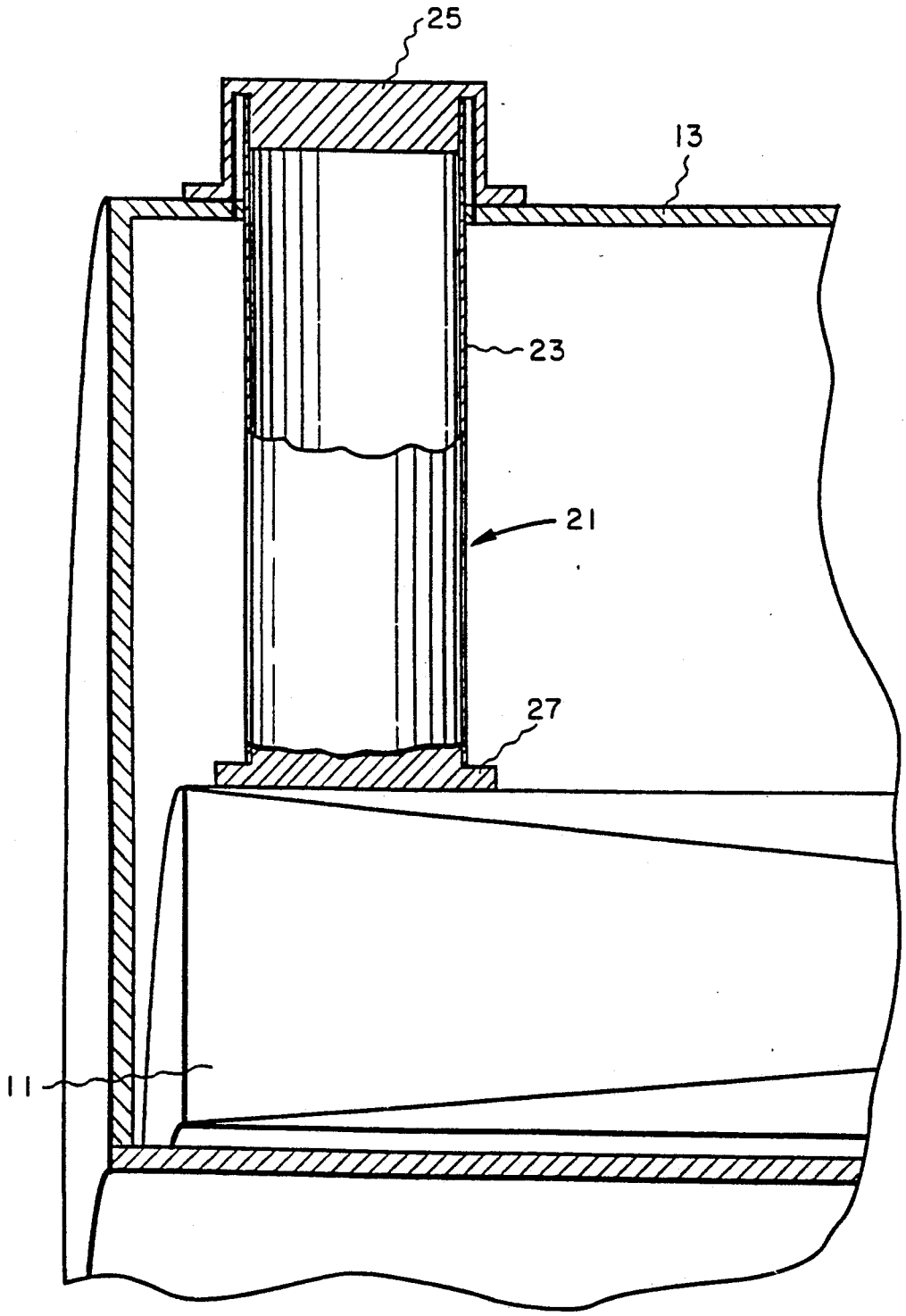
FIG. 2 is a partial sectional axonometric view of one of the thermal diodes of FIG. 1 supporting the magnet cartridge from the thermal radiation shield.

Referring now to the drawing, and particularly FIG. 1 thereof, a generally cylindrical vacuum vessel 5 having an axially extending bore 7 is shown. Situated inside the vacuum vessel are one or more superconductive coils on a coil form 11 concentrically situated around the bore but spaced away therefrom. A thermal radiation shield 13 encloses the superconductive coils. The thermal radiation shield 13 is supported from the vacuum vessel 5 by supports 6. A two stage cryocooler 15 is mounted in an aperture in the vacuum vessel 5 with the first and second stages of the cryocooler 17 and 19, respectively, extending into the vacuum vessel. The first stage 17 of the cryocooler 15 is in a heat transfer relationship with the thermal radiation shield 13. The second stage 19 extends through an aperture in the thermal radiation shield and is in a heat transfer relationship with the superconductive coils 11. The superconductive coils are supported from the thermal radiation shield by two generally vertically extending coil supports 21 which function as thermal diodes and which can be seen more clearly in FIG. 2. Each coil support 21 comprises a thin wall tube 23 which is sealed at either end by end caps 25 and 27 which serve as heat exchangers and are fabricated from of high thermal conductivity material such as copper. The thin wall tube can comprise stainless steel, for example, which is brazed to the end caps to create a pressure tight enclosure. To achieve an effective length of the coil support between the shield and the coil, longer than the distance therebetween, the end cap secured to the exterior of the thermal shield 13 extends radially outwardly with the thin wall tube extending through an aperture in the shield and through a centrally open area in the end support before it is brazed to the end cap. The upper heat exchanger 25 is secured to the thermal radiation shield which can be fabricated from aluminum by brazing for example. The lower heat exchanger 27 can be secured to the copper or aluminum shell surrounding the magnet cartridge 11, by brazing for example.

The pressure tight enclosure defined by the thin wall tube 23 and caps 25 and 27 contains a gas with a high thermal conductivity at a pressure which will provide a small quantity of the gas in liquid or solid form at the bottom of the enclosure when the magnet reaches its operating temperature. The gas should completely change to a liquid as the second stage temperature gets colder than the first stage temperature. If hydrogen gas is introduced into the enclosure at approximately 100 psi at room temperature, at 20K and one atmosphere the gas will become a liquid and at 14K will solidify Other gases which may be used are neon which will liquefy at 27K and solidify at 24.6K and nitrogen which will liquefy at 77K and solidify at 63K at one atmosphere. Mixtures of these gases may also be used to control the liquefying temperature within the tube and thereby enhance the heat transfer characteristics of the diode. The pressure in the tube can be changed to control the temperature at which liquefaction and solidification occurs.

In operation, the support 21 acts as a thermal diode. The support tube filled with a gas having a temperature gradient opposite the gravitational field gradient, that is a negative field gradient, will transport heat from the hot surface to the cold surface by natural convection. The transport results from the density gradient created by the temperature gradient along the vertical axis of the tube. A tube filled with hydrogen, for example, will transport heat between the top and bottom surfaces of the tube as long as a negative temperature gradient exists. Once the top and bottom surfaces reach the same temperature, the gas will stratify and the flow will stop. As the lower surface cools below 20K, the hydrogen will liquify eliminating all gaseous heat transfer between the surfaces. The one dimensional flow equation describing the principle is $$u\frac{du}{dx} = -g\left(\frac{T_2}{T_1} - 1\right) + \nu\frac{d^2u}{dx^2}$$

where $\vec{u}$ is the axial gas velocity g is the gravitational accelerator v is the kinematic gas velocity $T_1$ and $T_2$ are the first and second stage temperatures, respectively.

The use of the thermal diode quickens the cooldown of the refrigerated superconductive magnet. During cooldown, the larger first stage of the cryocooler will cool more rapidly due to the larger heat removal capacity of the first stage (typically 40–100 watts) creating a negative temperature gradient across the thermal diode resulting in the circulation of the hydrogen gas between the upper and lower surfaces. The transport of heat from the magnet windings to the radiation shield by each of the thermal diodes when the negative temperature gradient exists is given by $$Q = \tfrac{1}{2}(h_1 + h_2) \cdot A_S \cdot \Delta T$$

where

Q is the heat transported $h_1$ and $h_2$ is the heat transfer coefficient of each end of the tube, respectively.

$A_S$ in the effective heat transfer area $\Delta T$ is the temperature difference across the diode.

The enhanced heat transfer of the magnet windings allows the magnet windings to quickly be cooled to 40K by means of the thermal diode and then be cooled to 10K just by the second stage of the cryocooler without the use of the thermal diodes the thermal radiation shield and magnet windings are thermally insulated from one another and the second stage of the cryocooler has to do all the conduction cooling of the superconductive windings.

Cooling times for 0.5 T magnet are expected to go from 13 days to just 8 days or less using the same cryocooler with the addition of the thermal diodes.

The foregoing has described a refrigerated magnet which can be more quickly cooled without requiring a larger capacity cryocooler or the use of consumable cryogens.

What is claimed is:

1. A superconductive magnet comprising:

at least one superconductive coil;

a vacuum vessel;

a thermal radiation shield situated inside said vacuum vessel and enclosing said superconductive coil; and thermal diode means substantially enclosing a cryogenic gas means for thermally lining said superconductive coil and the thermal radiation shield when said thermal radiation shield is colder than the superconductive coil.

2. The superconductive magnet of claim 1 further comprising conduction cooling means for providing cooling at a first and a second temperature, said second temperature being lower than the first temperature, said thermal radiation shield conduction cooled by said conduction cooling means at the first temperature and said superconductive winding conduction cooled by said conduction cooling means at the second temperature.

3. The magnet in claim 1 further comprising a two stage cryocooler providing cooling at two temperatures, one at each stage, the second stage being capable of achieving a lower temperature than the first stage, said first stage coupled to said thermal radiation shield for providing conduction cooling and said second stage coupled to said superconductive coil for providing conduction cooling.

4. The magnet of claim 1 wherein said thermal diode means supports the superconductive winding from said thermal radiation shield.

5. The magnet of claim 1 wherein said thermal diode means comprises a pressure tight tube having heat transfer means enclosing either end of the tube, the heat transfer means of one end of the tube coupled in a heat transfer relationship with the thermal radiation shield and the heat transfer means on the other end of the tube coupled in a heat transfer relationship with the superconductive winding, the central axis of the tube situated substantially vertically with said heat transfer means at the end of the tube coupled in a heat transfer relationship with the thermal radiation shield located at the higher end.

6. The magnet of claim 2 wherein said thermal diode means supports the superconductive winding from said thermal radiation shield.

7. The magnet of claim 6 wherein said thermal diode means comprises a pressure tight tube having heat transfer means enclosing either end of the tube, the heat transfer means of one end of the tube coupled in a heat transfer relationship with the thermal radiation shield and the heat transfer means on the other end of the tube coupled in a heat transfer relationship with the superconductive winding, the central axis of the tube situated substantially vertically with said heat transfer means at the end of the tube coupled in a heat transfer relationship with the thermal radiation shield located at the higher end.

8. The magnet of claim 3 wherein said thermal diode means supports the superconductive winding from said thermal radiation shield.

9. The magnet of claim 8 wherein said thermal diode means comprises a pressure tight tube having heat transfer means enclosing either end of the tube, the heat transfer means of one end of the tube coupled in a heat transfer relationship with the thermal radiation shield and the heat transfer means on the other end of the tube coupled in a heat transfer relationship with the superconductive winding, the central axis of the tube situated substantially vertically with said heat transfer.

10. The magnet of claim 4 wherein said thermal diode means comprises a pressure tight tube having heat transfer means enclosing either end of the tube, the heat transfer means of one end of the tube coupled in a heat transfer relationship with the thermal radiation shield and the heat transfer means on the other end of the tube coupled in a heat transfer relationship with the superconductive winding, the central axis of the tube situated substantially vertically with said heat transfer means at the end of the tube coupled in a heat transfer relationship with the thermal radiation shield located at the higher end.

11. A superconductive magnet for magnetic resonance spectroscopy comprising:

at least one superconductive coil;

a vacuum vessel;

a thermal radiation shield situated inside said vacuum vessel and enclosing said superconductive coil; and a pressure tight tube having heat transfer means enclosing either end of the tube, said tube containing a gas, the heat transfer means on one end of the tube thermally connected to the thermal radiation shield and the heat transfer means on the other end of the tube thermally connected to the superconductive winding, the central axis of the tube situated substantially vertically, with said heat transfer means at the end of the tube thermally connected to the thermal radiation shield located at the higher end, so that the gas in the tube thermally links the two ends of the tube when the thermal radiation shield is colder than the superconductive winding.

12. The magnet of claim 11 wherein said pressure tight tube having heat transfer means enclosing either end supports the superconductive winding from said thermal radiation shield.

13. The superconductive magnet of claim 11 further comprising conduction cooling means for providing cooling at a first and a second temperature, said second temperature being lower than the first temperature, said thermal radiation shield conduction cooled by said conduction cooling means at the first temperature and said superconductive winding conduction cooled by said conduction cooling means at the second temperature.

14. The superconductive magnet of claim 12 further comprising conduction cooling means for providing cooling at a first and a second temperature, said second temperature being lower than the first temperature, said thermal radiation shield conduction cooled by said conduction cooling means at the first temperature and said superconductive winding conduction cooled by said conduction cooling means at the second temperature.

15. The magnet in claim 11 further comprising a two stage cryocooler providing cooling at two temperatures, one at each stage, the second stage being capable of achieving a lower temperature than the first stage, said first stage coupled to said thermal radiation shield for providing conduction cooling and said second stage coupled to said superconductive coil for providing conduction cooling.

16. The magnet in claim 12 further comprising a two stage cryocooler providing cooling at two temperatures, one at each stage, the second stage being capable of achieving a lower temperature than the first stage, said first stage coupled to said thermal radiation shield for providing conduction cooling and said second stage coupled to said superconductive coil for providing conduction cooling.

* * * * *